US006269581B1

(12) United States Patent
Groh

(10) Patent No.: US 6,269,581 B1
(45) **Date of Patent: *Aug. 7, 2001**

(54) RANGE COMPENSATING RIFLE SCOPE

(76) Inventor: John Groh, 8 Mustang Rd., Artesia, NM (US) 88210

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/290,340

(22) Filed: Apr. 12, 1999

(51) Int. Cl.[7] ..... F41G 1/38
(52) U.S. Cl. ..... 42/122
(58) Field of Search ..... 33/245, 246; 42/103; 89/41.06, 41.17

(56) References Cited

U.S. PATENT DOCUMENTS

| | | | | |
|---|---|---|---|---|
| 3,464,770 | * | 9/1969 | Schmidt | 364/4 |
| 4,285,137 | | 8/1981 | Jennie | 33/246 |
| 4,397,107 | | 8/1983 | Holden | 42/1 ST |
| 4,403,421 | | 9/1983 | Shepherd | 33/246 |
| 4,542,986 | * | 9/1985 | Berdanier | 89/41.06 |
| 4,561,204 | * | 12/1985 | Binion | 42/1 |
| 4,584,776 | | 4/1986 | Shepherd | 33/246 |
| 4,695,161 | * | 9/1987 | Reed | 356/254 |
| 4,965,439 | * | 10/1990 | Moore | 235/404 |
| 5,001,962 | * | 3/1991 | Schlegel et al. | 89/6.5 |
| 5,208,417 | * | 5/1993 | Langer et al. | 89/41.06 |
| 5,375,072 | * | 12/1994 | Cohen | 364/561 |
| 5,454,168 | | 10/1995 | Langner | 33/234 |
| 5,491,546 | | 2/1996 | Wascher | 356/4.03 |
| 5,575,072 | | 11/1996 | Eldridge | 33/265 |
| 5,652,651 | | 7/1997 | Dunne | 356/5.01 |
| 5,669,174 | | 9/1997 | Teetzel | 42/103 |
| 5,771,623 | * | 6/1998 | Pernstich et al. | 42/101 |
| 5,831,718 | * | 11/1998 | Desai et al. | 356/5.01 |
| 5,903,996 | * | 5/1999 | Morley | 42/103 |

* cited by examiner

*Primary Examiner*—Charles T. Jordan
*Assistant Examiner*—Denise J. Buckley
(74) *Attorney, Agent, or Firm*—John D. Gugliotta

(57) ABSTRACT

Disclosed is a rifle scope that utilizes laser range-finding and microprocessor technology to eliminate the need for the shooter to calculate bullet-drop compensation. The scope includes a laser range finder that calculates the distance between the user and the target that is focused in the cross-hairs. The user simply enters the muzzle velocity, i.e. the bullet speed of his particular ammunition as well as the current altitude using pushbuttons located on the scope assembly. A microprocessor automatically calculates the distance that the bullet traveling at the dialed-in speed will drop while traveling the distance calculated by the laser range finder, taking into consideration reduced drag at higher altitudes and the weight of the bullet. Based upon this calculated value, a second LCD image cross-hair is superimposed in the scope's viewfinder, indicating the proper position at which to aim the rifle in order to achieve a direct hit.

4 Claims, 4 Drawing Sheets

RANGE COMPENSATING RIFLE SCOPE

BACKGROUND OF THE INVENTION

1. Field of the Invention

Over the years, modern advances in hunting equipment have enhanced the sport, providing hunters with increased success. Among these products, high-powered rifle technology offers long-range targeting capabilities with a more true bullet flight that helps to enhance accuracy. However, even the most modern equipment cannot negate the effect that gravity has on targeting game. In any case, regardless of the equipment used, gravity draws a fired bullet toward the ground as is travels through the air. Depending upon the distance between the hunter and the target coupled with the speed of the bullet and drag forces, the distance that the bullet will drop prior to reaching the target varies. As a result, hunters are forced to estimate the bullet-drop and compensate by aiming slightly above their target. Some rifle scopes help the shooter to calculate this distance by providing special markings on the lens. However, the hunter is still required to calculate the estimated degree of overshoot in his head and is prone to mistakes that could cause him to miss the target. Accordingly, the need has developed for a game targeting system that takes the guess work out of bullet-drop calculations. The development of the present invention fulfills this need.

The present invention relates generally to sighting scopes used to aim rifles and the like, and more specifically to a rifle scope that incorporates the use of range finding laser electronics to detect target distance and automatically compensate for the bullet-drop of ammunition having a known muzzle velocity.

2. Description of the Related Art

A search of the prior art did not disclose any patents that read directly on the claims of the instant invention. However, the following references were considered related:

U.S. Pat. No. 5,669,174 issued to James W. Teetzel;

U.S. Pat. No. 4,584,776 issued to Daniel R. Shepherd;

U.S. Pat. No. 4,403,421 issued to Daniel R. Shepherd;

U.S. Pat. No. 4,397,107 issued to Gerald B. Holden;

U.S. Pat. No. 4,285,137 issued to Fred L. Jennie;

U.S. Pat. No. 5,575,072 issued to Gary Eldridge;

U.S. Pat. No. 5,491,546 issued to Rick R. Washer et al.;

U.S. Pat. No. 5,652,651 issued to Jeremy G. Dunne; and

U.S. Pat. No. 5,454,168 issued to F. Richard Langner.

While several features exhibited within these references are incorporated into this invention, alone and in combination with other elements, the present invention is sufficiently different so as to make it distinguishable over the prior art.

SUMMARY OF THE INVENTION

The present invention consists of an otherwise conventional rifle scope that utilizes laser range-finding and microprocessor technology to eliminate the need for the shooter to calculate bullet-drop compensation. The scope includes a laser range finder that calculates the distance between the user and the target that is focused in the cross-hairs. The user simply enters the muzzle velocity, i.e. the bullet speed of his particular ammunition as well as the current altitude using pushbuttons located on the scope assembly. A microprocessor automatically calculates the distance that the bullet traveling at the dialed-in speed will drop while traveling the distance calculated by the laser range finder, taking into consideration reduced drag at higher altitudes and the weight of the bullet. Based upon this calculated value, a second LCD image cross-hair is superimposed in the scope's viewfinder, indicating the proper position at which to aim the rifle in order to achieve a direct hit.

Accordingly, it is an object of the present invention to provide an improved rifle scope that automatically compensates for bullet-drop.

It is another object of the present invention to provide an improved rifle scope that incorporates the use of laser range finding technology to determine the distance to the selected target.

It is another object of the present invention to provide an improved rifle scope that calculates the degree of compensation using data pertaining to the muzzle velocity and grain weight of the ammunition being used as well as the approximate altitude at which the rifle is being fired.

It is another object of the present invention to provide an improved rifle scope that produces a superimposed cross-hair image in the scope viewfinder that indicates the appropriate aim that compensates for bullet-drop and will ensure a direct hit on the intended target.

It is another object of the present invention to provide an improved rifle scope wherein the user can manually enter ammunition data pertaining to muzzle velocity and grain weight as well as the altitude for calculation purposes.

It is another object of the present invention to provide an improved rifle scope that can be used in a manner identical to that of conventional rifle scopes if so desired.

Finally, it is an object of the present invention to provide an improved rifle scope that is lightweight, compact and easy to use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Scope
11 Mounting Devices
12 Body Portion
13 Eyepiece
15 Vertical Cross-Hair Adjustment Knob
16 Horizontal Cross-Hair Adjustment Knob
17 Vertical Sighting Cross-Hair
18 Horizontal Sighting Cross-Hair
20 Power Button
21 Interface Panel
22 Selection Button
23 Increase Button
24 Decrease Button
25 LCD Panel
26 Viewfinder Window
30 Compensation Cross-Hair
35 Velocity Line
36 Grain Line
37 Altitude Line
38 Range Line

DESCRIPTION OF THE PREFERRED EMBODIMENTS

Figure 1:
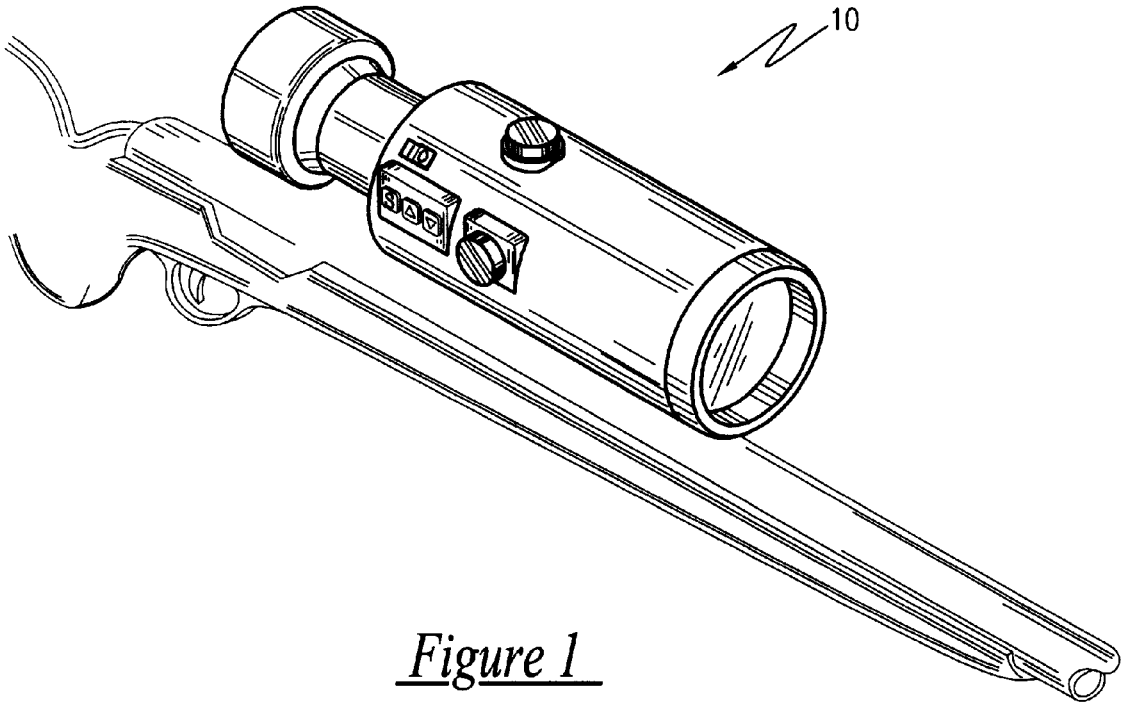
FIG. 1 is a perspective view of a range compensating rifle scope installed on a conventional rifle, according to the preferred embodiment of the present invention.
Figure 2:
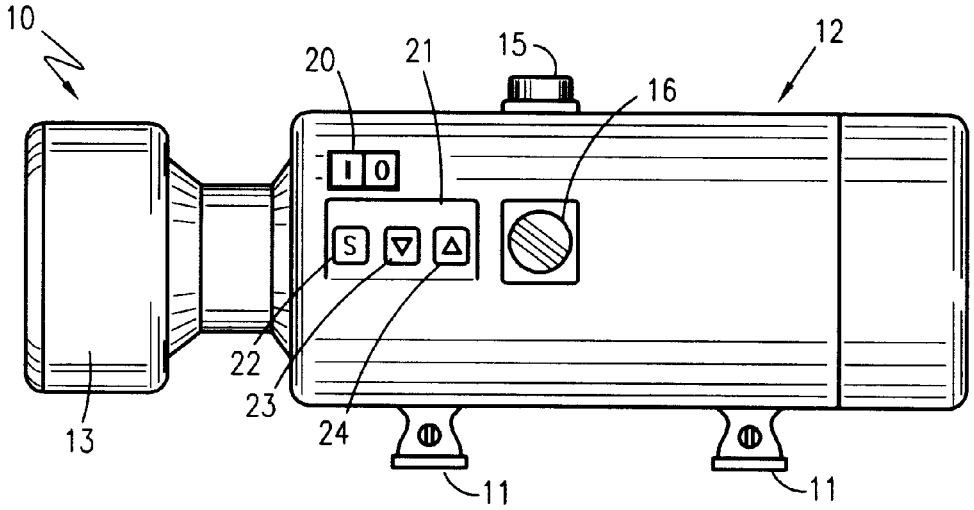
FIG. 2 is a side view of a range compensating rifle scope, according to the preferred embodiment of the present invention.
Figure 3:
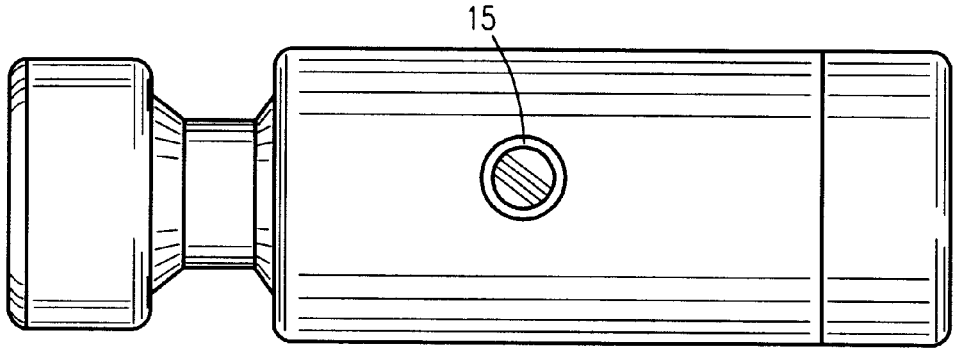
FIG. 3 is a top view of a range compensating rifle scope, according to the preferred embodiment of the present invention.
Figure 4:
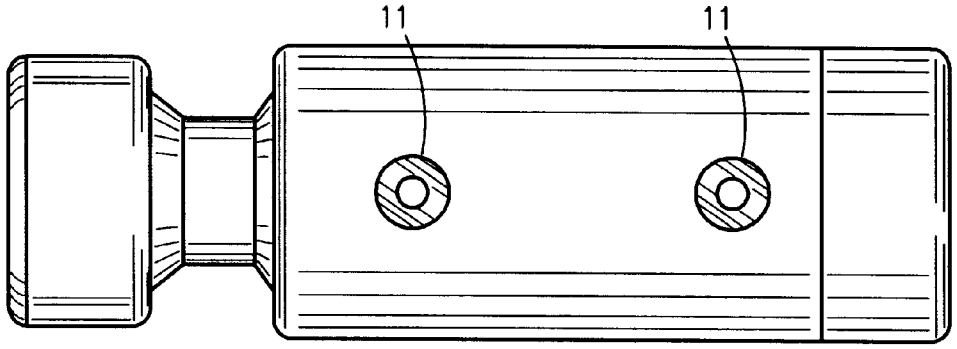
FIG. 4 is a bottom view of a range compensating rifle scope, according to the preferred embodiment of the present invention.

1. Detailed Description of the Figures Referring now to FIGS. 1–3, depicted is the range compensating rifle scope, hereinafter scope 10, according to the preferred embodiment of the present invention. The scope 10 is mounted to a conventional rifle (not shown) or the like via a pair of mounting devices 11 protruding from the body portion 12 thereof. The scope 10 has an eyepiece 13 through which the user looks in order to sight his target. A vertical cross-hair adjustment knob 15 and a horizontal cross-hair adjustment knob 16 allow the user to fine-tune the positioning of the vertical sighting cross-hair 17 and the horizontal sighting cross-hair 18, respectively. Using the vertical cross-hair adjustment knob 15 and a horizontal cross-hair adjustment knob 16, the user can "zero" the scope 10, in order to ensure the accuracy of the scope at close range where the effects of bullet-drop are negligible. In doing so, the user ensures that compensation at greater ranges, when taken from the "zeroed" cross-hairs, will produce an accurate shot. It should be noted that, if the user so desires, the scope 10 can be used as a conventional optical rifle scope without taking advantage of the bullet-drop compensation features incorporated therein. Furthermore, although it is realized that the benefit of automatic bullet-drop compensation increases proportionally with range distance and would best lend itself to incorporation into high-powered rifle scopes with a high degree of magnification, it should be noted that the technology of the present invention is not restricted to rifle scopes of any particular degree of magnification and can even be used with scopes of no magnification at all.

Figure 5:
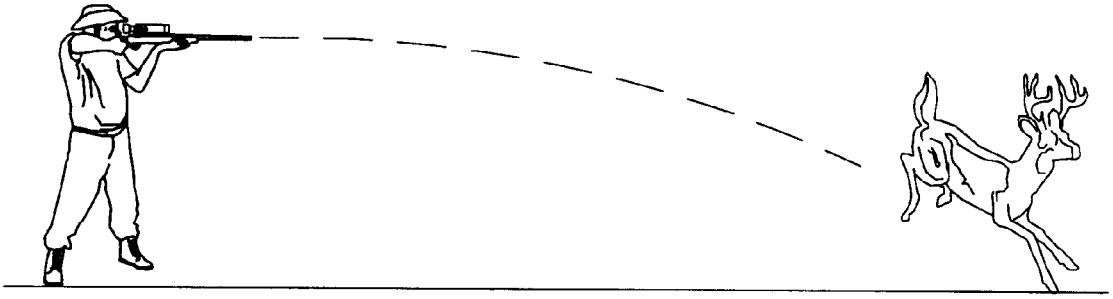
FIG. 5 is a side view of a shooter with a rifle conventionally aimed and the trajectory of a bullet fired without the aid of range compensating rifle scope, according to the preferred embodiment of the present invention.

When firing a bullet, there are several factors that act upon it and affect its trajectory. Gravity, of course, draws the bullet towards the earth at an effectively constant acceleration. As shown in FIG. 5, the bullet travels not in a straight path but rather in an arcuate path towards its target. The vertical component of this arcuate path between the shooter and the target is referred to as the bullet-drop. The longer the amount of time that the bullet spends during flight, the greater the amount of bullet-drop. The flight time of the bullet is determined basically according to the muzzle velocity of the bullet (the speed at which the bullet travels when leaving the gun barrel) and the range distance between the shooter and the target, with several variables that affect bullet flight factored in. Drag forces, i.e. wind resistance, slows the bullet, thereby increasing the travel time and therefore the amount of bullet-drop. As air density varies proportionally with increased altitude, the higher the altitude at which the bullet is fired reduces the degree of drag and therefore reduces bullet-drop. Finally, the greater the mass of the projectile, as indicated by the grain or weight of the bullet, the less effect that drag has upon it, all other factors remaining constant.

The scope 10 includes several electronic functions that are enabled by switching the power button 20 to the "on" position. Once activated, the user pre-programs the scope electronics (not shown) via an operator interface panel 21. The interface panel 21 includes a selection button 22, an increase button 23 and a decrease button 24. The selection button 22 cycles the scope electronics through several preset programming functions that the operator adjusts using the increase button 23 and the decrease button 24. The programming functions are displayed on an LCD panel 25, positioned beneath the viewfinder window 26 and viewed by the user through the eyepiece 13. The LCD panel 25 is positioned beneath the viewfinder window 26. The first programming function allows the user to "zero" the compensation cross-hair 30 by adjusting it until it coincides with the vertical sighting cross-hair 17. The user then enters the muzzle velocity and grain of the ammunition as well as the estimated altitude at which the gun is being used. These values are displayed on the LCD panel 25 on a velocity line 35, grain line 36 and altitude line 37.

Figure 6:
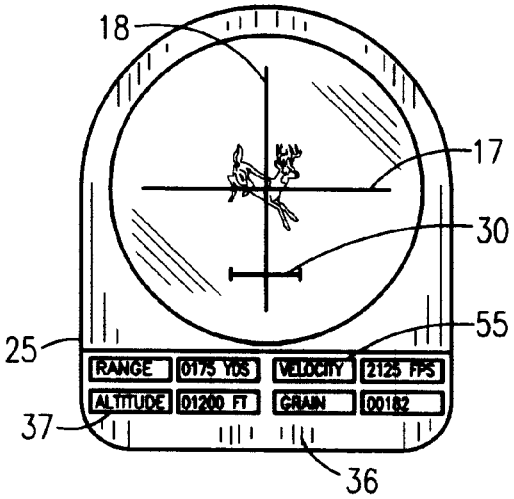
FIG. 6 is the view as seen through the scope viewfinder of the range compensating rifle scope without the compensation electronics activated, according to the preferred embodiment of the present invention.
Figure 7:
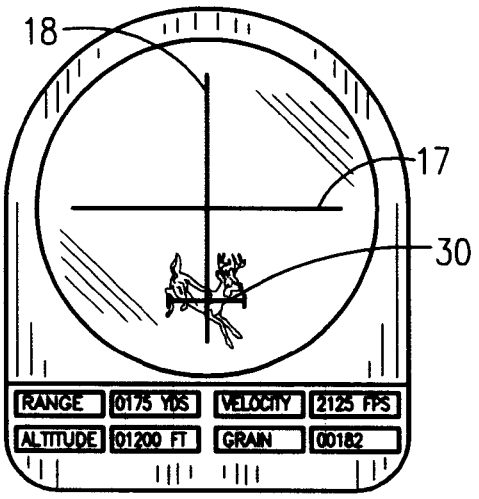
FIG. 7 is the view as seen through the scope viewfinder of the range compensating rifle scope with the compensation electronics activated, according to the preferred embodiment of the present invention.
Figure 8:
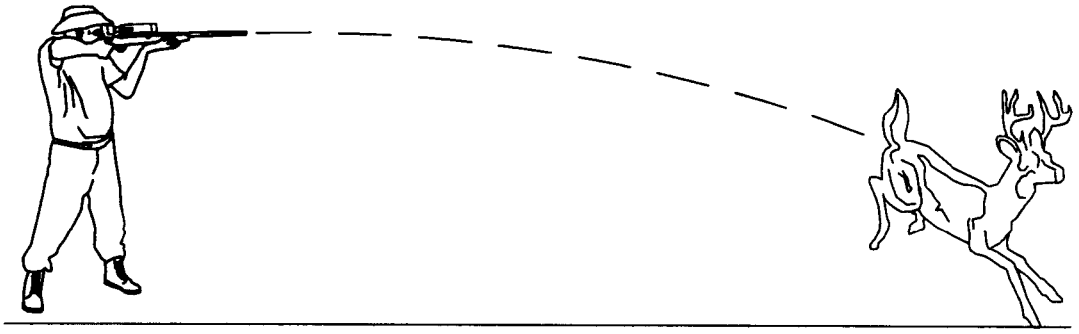
FIG. 8 is a side view of a shooter with a rifle aimed with the aid of a range compensating rifle scope and the trajectory of a bullet compensating for bullet drop, according to the preferred embodiment of the present invention.

The scope 10 also includes an integrated laser range finder (not shown) that automatically detects the distance between the rifle and the target. The range finder is set to detect the distance by aiming a laser light beam in a direction such that it coincides with whatever is lined-up at the intersection of the vertical sighting cross-hair 17 and the horizontal sighting cross-hair 18. In the preferred embodiment, the laser is pulsed repeatedly towards the target. As each pulse is initiated, a precision timing cycle is initiated simultaneously therewith. Knowing that the speed of light is essentially constant, the range between the scope 10 and the target can be calculated easily and accurately as a function of the time it takes for a pulse to reflect off the target back to the scope, simply by multiplying the calculated time by the known speed of light. Thus, the range is constantly and repeatedly calculated, updated and displayed on the range line 38 of the LCD panel 25. The range having been calculated, the requisite degree of compensation is calculated automatically, relying on the abovementioned principles. Shown in FIG. 6, this compensation is conveyed to the user via a compensation cross-hair 30 superimposed on the viewfinder window 26 below the vertical sighting cross-hair 17, creating an intersection with the horizontal sighting cross-hair 18. By aiming the rifle with the compensation cross-hair 30 as shown in FIG. 7, the rifle will be aimed above the intended target, as shown in FIG. 8, to a degree such that an accurate hit will be achieved in spite of the occurrence of bullet-drop.

What is claimed is:

1. A rifle scope that automatically calculates the requisite degree of bullet-drop compensation for a particular target, said rifle scope comprising:

an optical sighting means for viewing a target area, said sighting means having a housing supporting an eyepiece and at least one optical lense that comprise a field of view when viewed therethrough;

a cross-hair means having a vertical sighting cross-hair perpendicular to a horizontal sighting cross-hair for identifying an intended target, said cross-hair means spanning the interior of said sighting means in linear alignment with said optical lense and superimposed over said field of view;

a vertical cross-hair adjustment knob to allow for fine-tuning the positioning of the vertical sighting cross-hair;

a horizontal cross-hair adjustment knob to allow for fine-tuning the positioning of the horizontal sighting cross-hair;

a laser range finding means mounted in said housing, said range finding means calculating the range distance between said optical sighting means and said target;

a micro-processing means mounted in said housing;

a means for manually inputting data into said micro-processing means; and a display means for displaying said data, said display means mounted to said housing and visible in an area adjacent to said field of view;

wherein said micro-processing means calculates a bullet drop compensation distance automatically using said data in conjunction with said range distance, said compensation distance displayed in said field of view by a vertical compensation cross-hair.

2. The rifle scope of claim 1, wherein by using said vertical cross-hair adjustment knob and said horizontal cross-hair adjustment knob a user can "zero" the scope in order to ensure the accuracy of the scope at close range where the effects of bullet-drop are negligible.

3. The rifle scope of claim 2, further comprising:

an operator interface panel including a selection button, an increase button and a decrease button, said selection button for cycling the scope electronics through several preset programming functions that the operator adjusts using said increase button and said decrease button.

4. The rifle scope of claim 3, wherein said programming functions are displayed on an LCD panel positioned beneath a viewfinder window and viewed by the user through an eyepiece.

* * * * *